US010480883B2

(12) United States Patent
Smith

(10) Patent No.: US 10,480,883 B2
(45) Date of Patent: Nov. 19, 2019

(54) SILENCER WITH IMPROVED MOUNT

(71) Applicant: RA Brands, L.L.C., Madison, NC (US)

(72) Inventor: Michael Leighton Smith, Alpharetta, GA (US)

(73) Assignee: RA Brands, L.L.C., Madison, NC (US)

( * ) Notice: Subject to any disclaimer, the term of this patent is extended or adjusted under 35 U.S.C. 154(b) by 584 days.

(21) Appl. No.: 14/561,723

(22) Filed: Dec. 5, 2014

(65) Prior Publication Data

US 2015/0260472 A1 Sep. 17, 2015

Related U.S. Application Data

(60) Provisional application No. 61/912,199, filed on Dec. 5, 2013.

(51) Int. Cl.

| | |
|---|---|
| ***F41A 21/32*** | (2006.01) |
| ***F41A 21/30*** | (2006.01) |
| *F41A 21/34* | (2006.01) |

(52) U.S. Cl.

CPC ..... *F41A 21/30* (2013.01); *F41A 21/34* (2013.01)

(58) Field of Classification Search

CPC ..... F41A 21/00; F41A 21/30; F41A 21/32; F41A 21/325; F41A 21/34

USPC ..... 89/14.4; 181/223

See application file for complete search history.

(56) References Cited

U.S. PATENT DOCUMENTS

| | | | | |
|---|---|---|---|---|
| 959,400 | A * | 5/1910 | Stinson | 181/223 |
| 3,500,955 | A | 3/1970 | Werbell | |
| 3,667,570 | A | 6/1972 | WerBell, III | |
| 4,291,610 | A * | 9/1981 | Waiser | 89/14.4 |
| 4,907,488 | A * | 3/1990 | Seberger | 89/14.4 |
| 5,029,512 | A * | 7/1991 | Latka | 89/14.4 |
| 5,773,746 | A | 6/1998 | Vaden | |
| 6,257,147 | B1 * | 7/2001 | Davies | 102/439 |
| 6,308,609 | B1 * | 10/2001 | Davies | 89/14.4 |
| 6,374,718 | B1 * | 4/2002 | Rescigno et al. | 89/14.4 |
| 6,412,389 | B2 | 7/2002 | Fluhr | |
| 6,701,820 | B2 | 3/2004 | Fluhr | |
| D582,502 | S | 12/2008 | Brittingham | |
| D582,503 | S | 12/2008 | Brittingham | |
| D584,786 | S | 1/2009 | Brittingham | |
| D584,787 | S | 1/2009 | Brittingham | |
| D585,518 | S | 1/2009 | Brittingham | |
| D591,382 | S | 4/2009 | Brittingham | |
| 7,587,969 | B2 | 9/2009 | Silvers | |
| 7,588,122 | B2 | 9/2009 | Brittingham | |
| 7,594,464 | B2 * | 9/2009 | Dueck | 89/14.4 |
| 7,610,710 | B2 | 11/2009 | Brittingham | |
| 7,610,992 | B2 | 11/2009 | Brittingham | |
| 7,661,349 | B1 * | 2/2010 | Brittingham | 89/14.4 |

(Continued)

OTHER PUBLICATIONS

Advanced Armament Corp., Ase Utra Jet Z Cutaway, http://www.aacblog.com/ase-utra-jet-z-cutaway/,Aug. 26, 2008,(AccessedSep. 30, 2013).

*Primary Examiner* — Derrick R Morgan

(74) *Attorney, Agent, or Firm* — Womble Bond Dickinson (US) LLP

(57) ABSTRACT

A noise suppressor having a mounting system for releasably mounting the noise suppressor to a flash hider mounted to the barrel of a host firearm. The noise suppressor mounting system includes a stabilizing ring that engages the distal end region of the flash hider to help stabilize the mounting of the noise suppressor to the flash hider.

24 Claims, 5 Drawing Sheets

(56) References Cited

U.S. PATENT DOCUMENTS

| | | | | |
|---|---|---|---|---|
| 7,676,976 | B2 | 3/2010 | Dueck et al. | |
| 7,677,150 | B2 | 3/2010 | Dater et al. | |
| 7,735,406 | B1 * | 6/2010 | Olson | 89/14.3 |
| 7,743,693 | B1 | 6/2010 | Brittingham | |
| 7,789,009 | B1 | 9/2010 | Brittingham | |
| 7,874,238 | B2 | 1/2011 | Silvers | |
| 7,891,282 | B1 | 2/2011 | DeGroat | |
| 7,905,170 | B1 | 3/2011 | Brittingham et al. | |
| 7,905,171 | B1 | 3/2011 | Brittingham | |
| 7,946,069 | B2 | 5/2011 | Dueck et al. | |
| 7,987,944 | B1 | 8/2011 | Brittingham et al. | |
| 8,087,338 | B1 * | 1/2012 | Hines | 89/14.4 |
| 8,096,222 | B2 | 1/2012 | Silvers | |
| 8,210,087 | B2 | 7/2012 | Latka | |
| 8,272,306 | B1 | 9/2012 | Smith | |
| 8,307,946 | B1 | 11/2012 | Johnston | |
| 8,387,299 | B1 | 3/2013 | Brittingham et al. | |
| 8,424,441 | B2 | 4/2013 | Brittingham et al. | |
| 8,459,406 | B1 * | 6/2013 | Dueck | 181/223 |
| 8,474,361 | B2 | 7/2013 | Brittingham | |
| 8,516,941 | B1 | 8/2013 | Oliver | |
| 8,579,075 | B2 | 11/2013 | Brittingham et al. | |
| 2003/0019351 | A1 * | 1/2003 | Fluhr | 89/14.4 |
| 2007/0266844 | A1 * | 11/2007 | Dueck | 89/14.4 |
| 2008/0098880 | A1 * | 5/2008 | Brugger | 89/14.4 |
| 2010/0139145 | A1 * | 6/2010 | Brittingham | 42/90 |
| 2011/0197487 | A1 * | 8/2011 | Humston | 42/1.06 |
| 2012/0048100 | A1 * | 3/2012 | Davies | 89/14.2 |
| 2013/0180797 | A1 * | 7/2013 | Dueck | 181/223 |
| 2014/0020977 | A1 * | 1/2014 | Shults | 181/223 |
| 2014/0231168 | A1 * | 8/2014 | Dueck et al. | 181/223 |
| 2015/0260472 | A1 | 9/2015 | Smith | |

* cited by examiner

SILENCER WITH IMPROVED MOUNT

CROSS-REFERENCE TO RELATED APPLICATION

This application claims the benefit of U.S. Provisional Application No. 61/912,199 filed Dec. 5, 2013, the entire disclosure of which is incorporated herein by reference.

FIELD OF THE INVENTION

The present invention generally relates to noise and/or flash suppressors for use with firearms, and in particular to a silencer or noise suppressor adapted for rapid and secure mounting over a flash suppressor/flash hider affixed to the muzzle of a host firearm barrel with the noise suppressor stabilized against undesirable vibration during firing of the host firearm.

BACKGROUND

Muzzle flash occurs due to the contact of propellant with air at the muzzle end of the firearm barrel, which causes the combustion of residual, unburned propellant as it exits the barrel of a firearm. Muzzle flash is undesirable, especially in combat or other tactical situations where the flash of light created can readily give away the position or location of a shooter at night or under other low ambient light conditions, such that it is common for soldiers and police officers and other shooters to routinely mount flash hiders or flash suppressors over the muzzle end of their firearms. In addition, firearm noise suppressors or silencers have been developed for uses such as special operations combat and variety of further tactical and other situations in which a reduction in the report or sound level created by the firing of a weapon is necessary. It therefore further is advantageous for shooters to be able to quickly and easily mount a silencer or noise suppressor over a flash hider or flash suppressor that is already affixed to the end of a firearm barrel, without requiring the flash hider to first be removed. In recent years, newer flash hider designs and noise suppressors have been developed to facilitate the use of noise suppressors with such flash hiders and which provide a lockable mounting system for attaching the noise suppressors over the flash hiders. It has, however, been observed that at least some types of flash hiders, while being particularly susceptible to the mounting of a noise suppressor thereover, can tend to vibrate and/or exhibit a ringing effect during firing, especially during periods of rapid or fully automatic fire. Such vibration can affect the stability of the mounting of the noise suppressor over the flash hider, which in turn can potentially affect the ability of the shooter to consistently place shots within a desired tight grouping.

Accordingly, it can be seen that a need exists for an improved mounting system for the mounting of a noise suppressor to a firearm, which is capable of mounting over an existing flash hider and which provides a stable and secure mounting between the noise suppressor and flash hider that addresses the foregoing and other related and unrelated problems in the art.

SUMMARY

Briefly described, the present disclosure generally relates to a noise suppressor or silencer having a mounting system for mounting the noise suppressor over an existing flash hider already mounted to the barrel of a host firearm, without requiring removal of the flash hider, and which mounting system provides an improved stability of the connection between the flash hider and noise suppressor so as to help substantially minimize and/or dampen vibration of the silencer and/or flash hider created during firing of the host firearm. The noise suppressor or silencer of the present disclosure thus can be quickly and securely mounted over a flash hider, with a forward region, such as the distal end region, of the flash hider being engaged and stabilized against vibration and/or other inadvertent movement during firing. In one embodiment, the noise suppressor can be adapted to mount over a multi-pronged or tined flash hider having a body with a first or proximal end region that typically will be mounted over the muzzle end of a firearm barrel, an annular locking surface and/or a threaded attachment mechanism adjacent the proximal end, and which further includes a series of forwardly extending tines or prongs separated by slots therebetween and terminating at a distal end region of the flash hider.

The noise suppressor or silencer of the present disclosure generally will include an elongated body having a proximal end in which the flash hider will be received for mounting the noise suppressor over the flash hider, and a distal end at the opposite end of the body. A longitudinal passage is defined through the body of the noise suppressor through which bullets will pass upon firing. The noise suppressor further can include a series of baffles mounted along an interior of the body and defining a series of gas expansion chambers therebetween. An initial or blast chamber further can be defined between a first, rearmost or upstream baffle and the proximal end region of the noise suppressor body.

The mounting system for the noise suppressor, in one embodiment, can include a one or more internal threads adapted to engage corresponding thread(s) of the attachment mechanism formed about the body of the flash hider, and further can optionally include a locking latch, comprising a spring biased latch arm adapted to engage the teeth of the annular locking surface formed about the proximal end region of the flash hider as the noise suppressor is fastened thereto. The engagement between the locking latch of the noise suppressor mounting system and the teeth of the annular locking surface of the flash hider help secure the noise suppressor over the flash hider and against rotation.

In addition, the mounting system can include at least one stabilizing feature that can be in the form of a stabilizing ring, which, in one embodiment, generally can comprise a cylindrical member attached to the interior wall of the noise suppressor body. The stabilizing ring generally will include an enlarged central opening in which the distal end region of the flash hider will be received, and further can include a tapered edge or beveled surface about its central opening, which can help guide the distal end region of the flash hider into the central opening, whereupon the end regions of the tines or prongs of the flash hider can be engaged and subjected to compression. This compression of the tines or prongs of the flash hider will be sufficient to substantially fix the tines or prongs against vibration during firing, while generally providing a minimal degree of internal movement of the tines or prongs. As a result, the prongs or tines of the flash hider will be placed under at least a tension force sufficient to dampen and/or resist vibration, but without affecting the path of a bullet moving through the flash hider and through the central channel of the noise suppressor body. The stabilizing ring further can be provided with a series of openings, channels or other surface features along a front side thereof that faces into a downstream or forwardmost portion of the initial or blast chamber of the noise suppressor, to help facilitate turbulence of the expanding gases of propulsion received within the blast chamber.

In accordance with an aspect of this disclosure, a noise suppressor, which can be configured for mounting over a flash hider attached to a barrel of a host firearm, includes a body having a proximal end and a distal end, wherein the body defines an internal chamber positioned between the proximal and distal ends, and the noise suppressor further includes a series of baffles mounted along the internal chamber of the body, and a mounting system for mounting the noise suppressor to the flash hider. The mounting system can include both a proximal mount and a stabilizing ring. The proximal mount can be positioned proximate the proximal end of the body for at least partially mounting the noise suppressor to the flash hider. The stabilizing ring can be mounted along the body of the noise suppressor. The stabilizing ring can have a central opening positioned in the internal chamber and configured to receive at least part of a distal end region of the flash hider therein, so as to engage and apply a compressive force to at least one outermost surface of the distal end region of the flash hider sufficient to substantially dampen any vibration of at least one of the noise suppressor and the flash hider created during firing of the host firearm.

One aspect of this disclosure is the provision of a noise suppressor configured for mounting over a flash hider that can be attached to a barrel of a host firearm, wherein the noise compressor can include a body, a series of baffles, a mount and a stabilizer. The body can have a proximal end and a distal end, and an internal chamber positioned between the proximal and distal ends. The series of baffles can be mounted along the internal chamber of the body, so that the series of baffles is positioned in the internal chamber, and a portion of the internal chamber is positioned between the proximal end of the body and a rearmost baffle of the series of baffles. The mount can be positioned proximate the proximal end of the body for at least partially mounting the noise suppressor to the flash hider. The stabilizer can extend into the internal chamber at a position between the mount and the series of baffles so that the stabilizer at least partially divides the internal chamber. An inner surface of the stabilizer can extend at least partially around an opening positioned in the internal chamber for receiving a portion of the flash hider therein. The inner surface of the stabilizer can be configured for extending at least partially around and engaging at least one outer surface of the portion of the flash hider, such as for applying a radially inward compressive force to the flash hider for substantially dampening any vibration of at least one of the noise suppressor and the flash hider created during firing of the host firearm. The mount and the stabilizer can together be part of a mounting system.

According to one aspect of this disclosure, a noise suppressor, which can be configured for mounting over a flash hider attached to a barrel of a host firearm, includes a body, a series of baffles, and a mounting system for mounting the noise suppressor to the flash hider. The body can have a proximal end and a distal end, and an internal chamber positioned between the proximal and distal ends. The series of baffles can be positioned in and mounted along the internal chamber of the body, so that a portion of the internal chamber is positioned between the proximal end of the body and a rearmost baffle of the series of baffles. The mounting system can include both proximate and medial mounts. The proximal mount can be positioned proximate the proximal end of the body for at least partially mounting a proximal end region of the noise suppressor to the flash hider. The medial mount can extend inwardly from the body at a position between the proximal mount and the series of baffles so that the medial mount at least partially divides the internal chamber. The medial mount can include an inner surface extending at least partially around an opening positioned in the internal chamber for receiving a portion of the flash hider therein. The inner surface of the medial mount can be configured for extending at least partially around and engaging at least one outer surface of the portion of the flash hider for substantially dampening any vibration of at least one of the noise suppressor and the flash hider created during firing of the host firearm. The medial mount may include or be in the form of a stabilizer, stabilizing ring, or other suitable feature.

An aspect of this disclosure is the provision of a method for mounting a noise suppressor over a flash hider that can be attached to a barrel of a host firearm. For example, the method can include causing relative movement between the noise suppressor and the flash hider so that the flash hider becomes at least partially positioned within an internal chamber of the noise suppressor. In response to the relative movement, there can be engaging between a proximal end region of the noise suppressor and a proximal end region of the flash hider, wherein the engaging between the proximal end region of the noise suppressor and the proximal end region of the flash hider can be comprised of engaging between an inner surface of the proximal end region of the noise suppressor and at least one outer surface of the proximal end region of the flash hider. In response to the relative movement, there can also be engaging between a medial portion of the noise suppressor and a forward region of the flash hider that is spaced art from the proximal end region of the flash hider, wherein the engaging between the medial portion of the noise suppressor and the forward region of the flash hider is comprised of engaging between an inner surface of the medial portion of the noise suppressor and at least one outer surface of the forward region of the flash hider. At least one engaging selected from the group consisting of the engaging between the proximal end region of the noise suppressor and the proximal end region of the flash hider, and the engaging between the medial portion of the noise suppressor and the forward region of the flash hider, can at least partially mount the noise suppressor over the flash hider, such as by way of an interference fit. The interference fit can be between the medial portion of the noise suppressor and the forward region of the flash hider, for substantially dampening any vibration of at least one of the noise suppressor and the flash hider created during firing of the host firearm. The medial portion of the noise suppressor can be in the form of a stabilizer, stabilizing ring, or other suitable feature of the noise suppressor, and the forward region of the flash hider may be a distal end region of the flash hider.

Various features, objects and advantages of the present invention will become apparent to those skilled in the art upon a review of the following detailed description, when taken in conjunction with the accompanying drawings.

Figure 1:
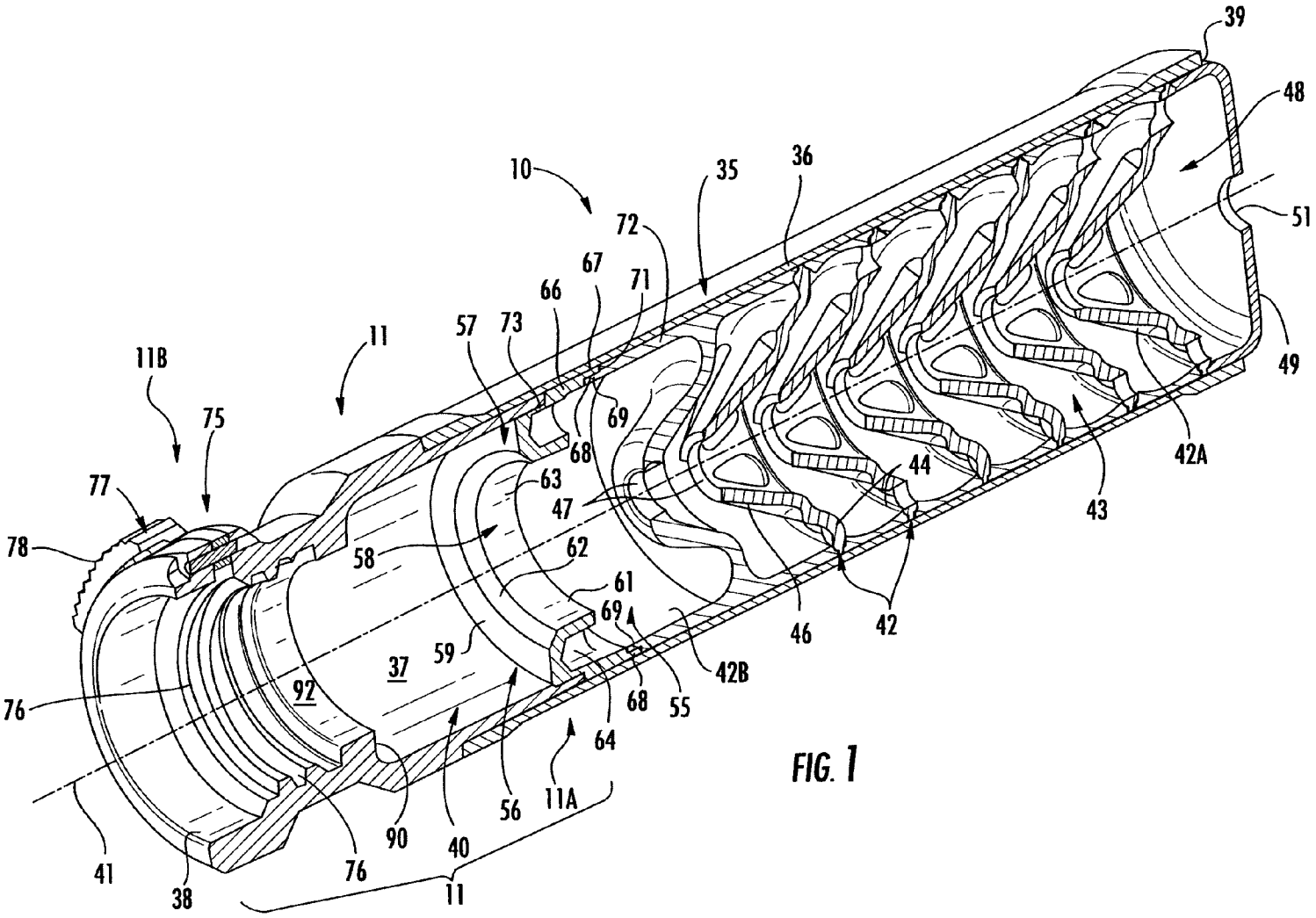
FIG. 1 is a perspective, cross-sectional view of a noise suppressor with a mounting system in accordance with an embodiment of this disclosure.

The embodiments of the invention and the various features thereof are explained below in detail with reference to non-limiting embodiments and examples that are described and/or illustrated in the accompanying drawings. It should be noted that the features illustrated in the drawings are not necessarily drawn to scale, and features of one embodiment may be employed with other embodiments as the skilled artisan would recognize, even if not explicitly stated herein. Descriptions of certain components and processing techniques may be omitted so as to not unnecessarily obscure the embodiments of the invention. The examples used herein are intended merely to facilitate an understanding of ways in which the invention may be practiced and to further enable those of skill in the art to practice the embodiments of the invention. Accordingly, the examples and embodiments herein should not be construed as limiting the scope of the invention, which is defined solely by the appended claims and applicable law.

DETAILED DESCRIPTION

Figure 2A:
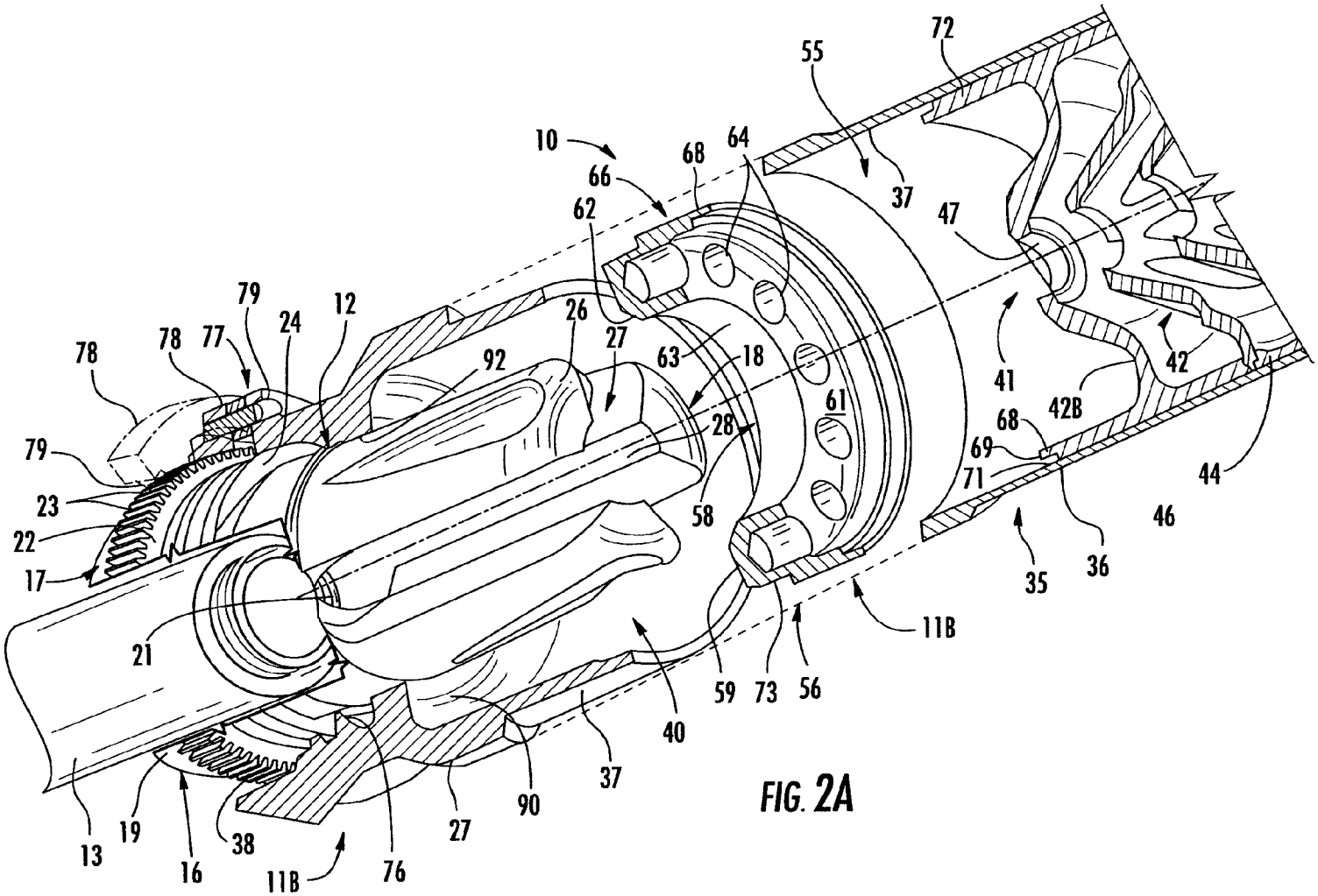
FIG. 2A is a partially cut-away, partially exploded, perspective view of the noise suppressor of FIG. 1 mounted over a flash hider, in accordance with an embodiment.
Figure 2B:
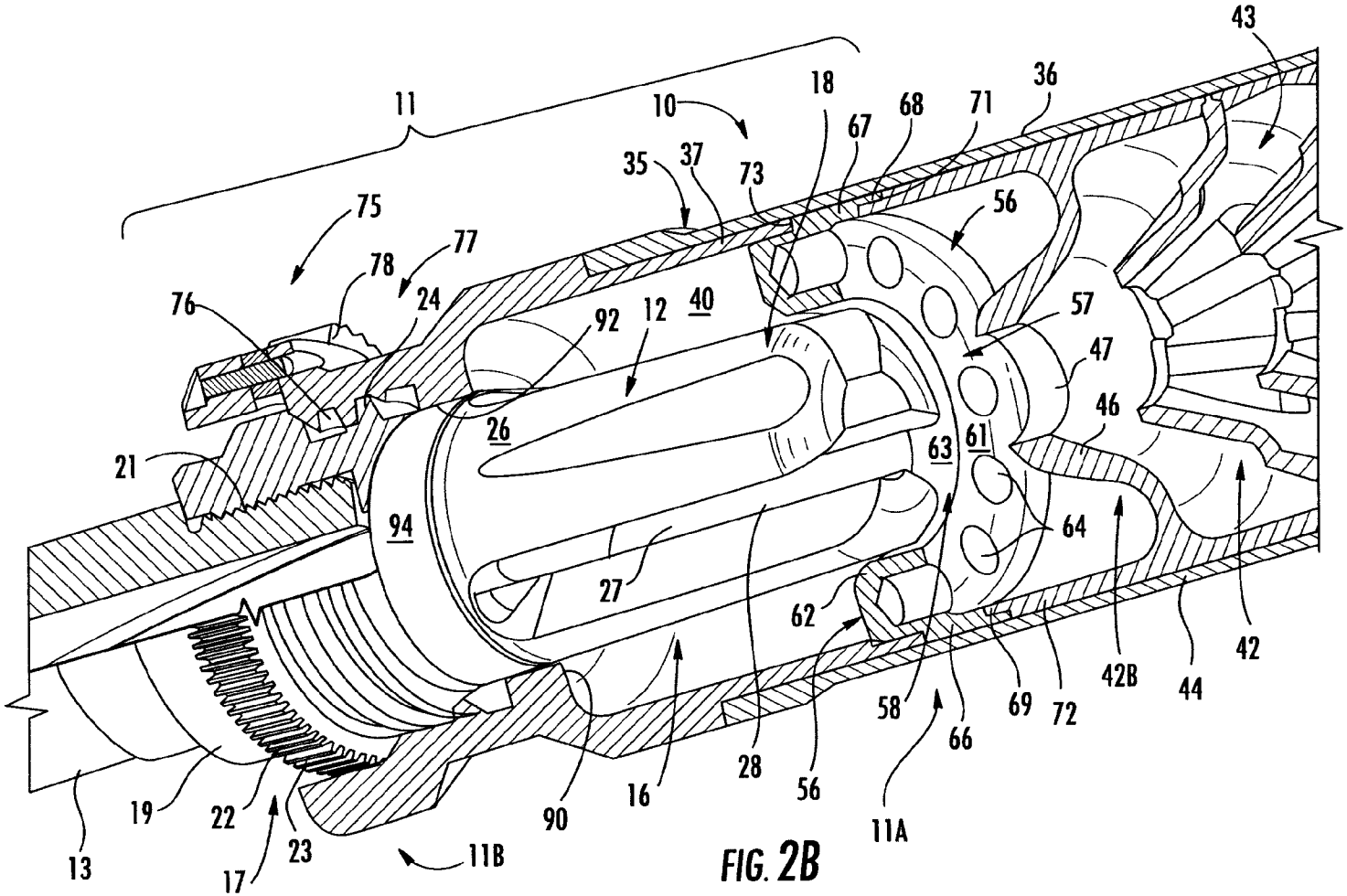
FIG. 2B is a perspective illustration, taken in partial cross-section, illustrating the engagement between a stabilizing ring of the noise suppressor and the flash hider when the noise suppressor is mounted over the flash hider.

Referring now to the drawings in which like numerals indicate like parts throughout the several views, FIGS. 1-2B generally illustrate one embodiment of a silencer or noise suppressor 10 with a mounting system 11 for mounting the silencer or noise suppressor to a flash hider 12 (FIGS. 2A-2B) or flash suppressor which may be previously mounted or fixed to the barrel 13 (FIG. 2A) of a host firearm. The noise suppressor 10 is designed to provide a quick, secure mounting system for mounting the noise suppressor over an existing flash hider 12, which further provides enhanced contact with the flash hider, increasing the stability of the mounting between the noise suppressor and flash hider so as to thus substantially minimize and/or dampen vibration, wobbling or other movement that can be created during firing of the host firearm as bullets and expanding gases from firing pass through the flash hider and noise suppressor.

Figure 3:
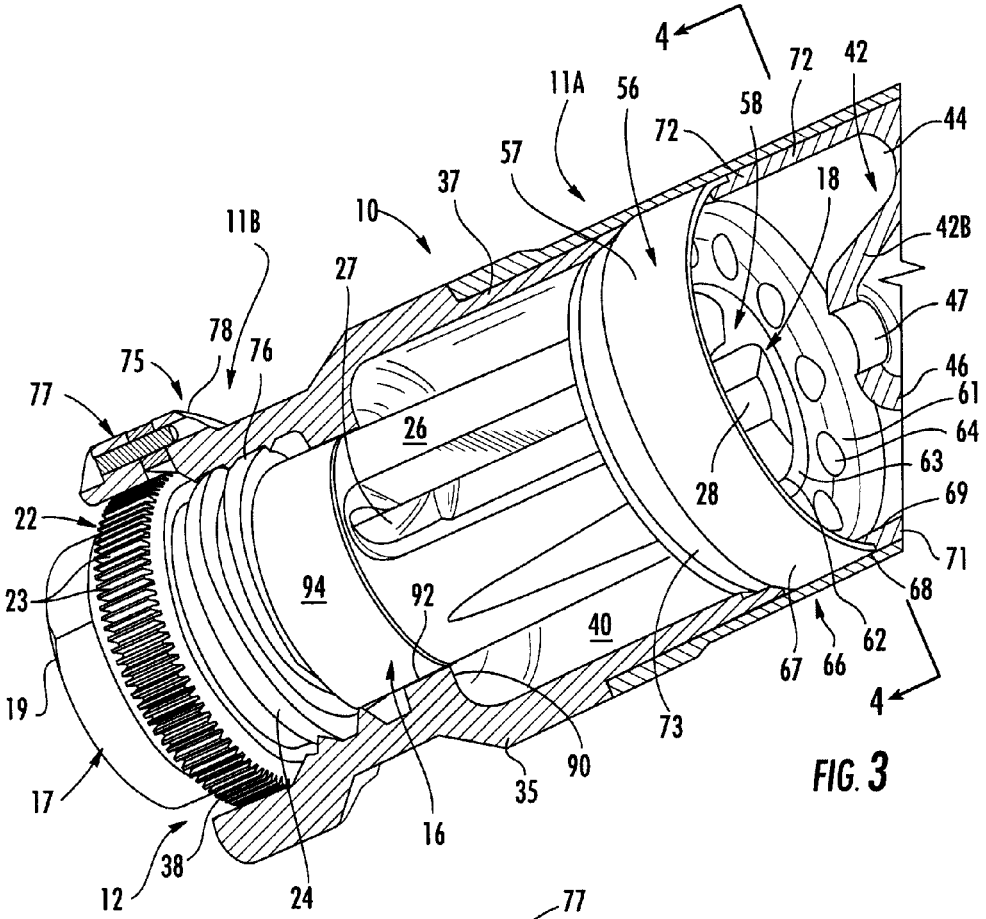
FIG. 3 is a partially cut-away perspective view illustrating the engagement between the stabilizing ring and distal end region of the flash hider.
Figure 4:
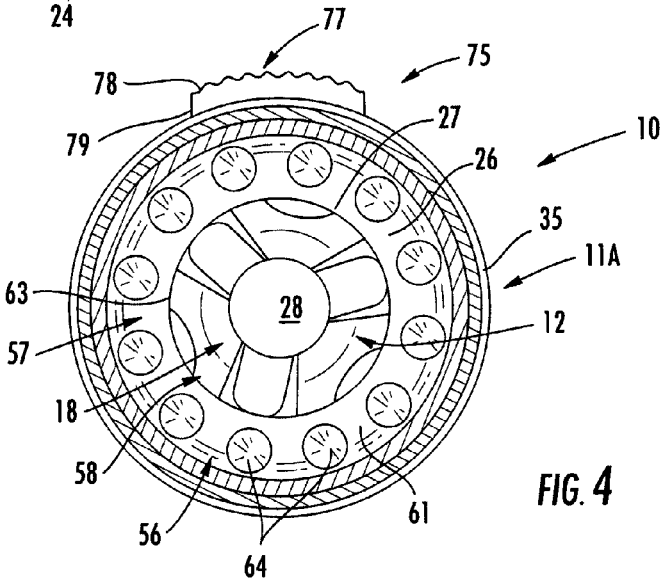
FIG. 4 is a cross-sectional view taken substantially along line 4-4 of FIG. 3.

As illustrated in FIGS. 2A-3, in one embodiment, the flash hider/flash suppressor 12 can include a multi-pronged or tined style flash hider, such as an Advanced Armament Corp. "Blackout®" style flash hider, although other types or designs of flash hiders also can be used. In the embodiments illustrated in the drawings, the flash hider 12 generally will include an elongated body 16 having a proximal end region 17 and a forward region, wherein the forward region can more specifically be a distal end region 18. The proximal end region 17 of the flash hider 12 can be formed with a socket 19 or similar type of connector, typically including a threaded connection 21 for connecting to a corresponding threaded portion of the firearm barrel 13. Optionally, an annular locking surface portion 22 also can be formed adjacent the socket portion 19 of the flash hider body 16, and can include a series of radially projecting teeth 23 formed thereabout. In addition, optionally a threaded connector 24 (for example, an ACME thread or other similar connector) can be formed about the body 16 in front of the annular locking surface or portion 22, for providing a connecting mechanism to connect the flash hider 12 to the noise suppressor 10 as illustrated in FIGS. 2A-2B.

As additionally shown in the illustrated embodiment, the flash hider or flash suppressor 12 further can include a series of prongs or tines 26 that extend forwardly, terminating at the distal end region 18 of the flash hider body 16, with a series of slots 27 being formed between the spaced tines 26. As further illustrated in FIGS. 2A-2B, a central passage 28 generally will be defined through the body 16 of the flash hider 12, through which bullets will pass during firing of the host firearm. It further will be understood by those skilled in the art that other flash hider configurations also can be used, including flash hiders without multiple prongs or tines, in addition to the multi-pronged or tined style flash hider 12 illustrated in the drawings.

As illustrated in FIG. 1, the silencer or noise suppressor 10 generally includes an elongated body 35, here shown as having a substantially cylindrical construction although other constructions, i.e., rectangular, etc. also can be used. The body 35 generally will include an outer wall 36, with an inner wall 37 defining an open space or compound chamber 40 therein, and will include a first or proximal end 38 and a second or distal end 39. A central passage 41 is further formed through the body 35 of the noise suppressor 10, which passage 41 generally will be aligned with the central passage 28 (FIGS. 1A and 2B) formed through the flash hider body 16 for passage of bullets therethrough.

As generally illustrated in FIGS. 1-2B, a series of baffles 42 generally will be mounted along the inner wall 37 of the noise suppressor body 35, with the baffles being arranged in spaced locations along the inner compound chamber 40 thereof so as to define a series of gas expansion chambers 43 therebetween. In one embodiment, the baffles 42 are shown as having a generally conical configuration, each including a base portion 44 that can be welded or otherwise mounted to the inner wall 37 of the noise suppressor body 35, and a tapered or conical section 46 that projects rearwardly from the base 44 along the central passage 41 defined through the noise suppressor body, and which further includes a central opening 47. One example construction of the baffles 42 that can be used in the silencer or the noise suppressor 10 is taught in U.S. Pat. No. 8,579,075, the disclosure of which is incorporated by reference as if set forth fully herein. Other baffle constructions also can be used, and the number and spacing of the baffles 42 further can be varied as will be understood by those skilled in the art.

As further illustrated in FIG. 1, a distal chamber 48 will be defined in front of the last or forwardmost baffle 42A, which distal chamber can be of a larger size or dimension than the interim expansion chambers 43. The distal chamber 48 can be at least partially defined by an end plate 49 having a central opening 51 formed therein being attached over the distal end 18 of the noise suppressor body 35 and enclosing the distal chamber 48. In addition, at least a portion of a first chamber, an initial chamber, or blast chamber 55 can be at least partially formed between the downstream side of the rearmost baffle 42B and at least one stabilizer that can be in the form of a compression or stabilizing ring 56 of the mounting system 11 of the noise suppressor 10. This blast chamber 55 can have an expanded or enlarged configuration to allow for greater expansion of the gases of propulsion as they enter the body of the noise suppressor 10. A portion of the blast chamber 55 can also extend rearwardly from the stabilizing ring 56, as will be discussed in greater detail below.

As shown in FIGS. 1-2B, the mounting system 11 of the noise suppressor 10 can include a releasable locking mount 75 at or proximate its proximal end 38, and the stabilizing ring 56 mounted along its internal compound chamber 40 for securely and stably mounting the noise suppressor over the flash hider 12 as shown in FIG. 2B. As FIGS. 1-4 indicate, the stabilizing ring 56 generally can include a substantially circular or cylindrical body 57 typically formed out of a rigid, high-strength material and which includes an expanded or enlarged central opening 58, thus providing the stabilizing ring with a generally doughnut-shaped configuration, and further including a first or rearward facing surface 59 and a second or forward facing surface 61. More generally, the stabilizing ring 56 can be in the form of a radially inwardly extending flange of the body 35 of the noise suppressor 10. Other configurations of the stabilizing ring 56, designed to substantially match the configuration of the noise suppressor body 35, and including a central opening 58 configured to receive the distal end region 18 of a flash hider 12 therein, also can be provided.

In one embodiment, the body 57 of the stabilizing ring 56 can be made from a rigid, high-strength metal material such as heat treated Inconel 718 steel, or can be formed from other high-strength metal and/or synthetic materials having a high strength and ability to withstand intense heat and abrasion from unburned propellant passing through the blast chamber 55 of the noise suppressor body 35. The body 57 of the stabilizing ring 56 further can have a thickness, as measured along the length of the noise suppressor 10, that can be within a range of approximately 0.1 inch to approximate 0.5 inches, although other, greater or lesser sizes can be used. The body 57 of the stabilizing ring 56 can include an annular inner wall 63 that extends around and defines the central opening 58. A beveled or contoured guide surface 62 also can be formed between the rear surface 59 and the inner wall 63 of the central opening 58 to facilitate the receipt and guidance of the tines 26 of the flash hider 12 into an engaged, stabilized position received within the central opening 58 of the stabilizing ring 56, as illustrated in FIGS. 2B-4. The guide surface 62 can be frusto-conical, such that it is inclined relative to the lengthwise axis of the noise suppressor 10.

In addition, a series of recesses 64, here shown as circular openings, but which could also include slots, depressions, channels or other surface features, also can be formed in the second or forward facing surface 61 of the body 57 of the stabilizing ring 56. Such recesses 64 generally will be formed at desired spacings about the forward facing surface 61 of the body 57 of the stabilizing ring 56 and can include a desired number of recesses designed to help facilitate the creation of turbulence in the expanding propulsion gases received within the blast chamber 55 to further assist in sound reduction as bullets and the expanding gases from firing pass through the noise suppressor body 35.

FIGS. 2B and 3 illustrate the engagement of the distal end region 18 (i.e., the end regions of tines 26) of the flash hider 12 within the central opening 58 of the stabilizing ring 56. This engagement of the distal end region 18 of the flash hider 12 within the stabilizing ring 56 tends to cause the tines 26 of the flash hider to be slightly squeezed or compressed, creating at least tension or dampening force that is applied along the prongs or tines to help stabilize the mounting between the noise suppressor and flash hider, such that vibration or other oscillating movement that can be created during the passage of bullets and gases from firing therethrough is substantially minimized and/or dampened, providing and maintaining an enhanced, more stable and consistently solid engagement between the noise suppressor and the flash hider during firing. The tension force created by the compressive engagement of the tines 26 or prongs of the flash hider 12 by the stabilizing ring 56 further can help reduce or substantially eliminate ringing that can occur when the host firearm is discharged.

The stabilizing ring 56 can be secured to the interior wall of the noise suppressor body 35 by welding or other means of attachment. As shown in the illustrated embodiment, such attachment further can include a band or forwardly extended, annular side wall portion 66 of the stabilizing ring 56 that can be received within a corresponding annular recess 67 formed in the interior side wall of the noise suppressor body 35. Such a mounting can help affix the stabilizing ring 56 to the body 35 of the noise suppressor 10 or silencer in a substantially unitary or integrated arrangement that can help further stabilize the mounting between the flash hider 12 and noise suppressor, as well as increase the dampening effects against vibration thereof. The band or side wall portion 66 of the stabilizing ring 56 further can include a rim or projection 68, which engages a corresponding projection 69 and a recess 71 formed along a rearwardly extending wall section 72 of the rearmost baffle 42B, so that the baffle structure and stabilizing ring can be secured together along the body of the silencer or noise suppressor in an interlocked, tongue-in-groove type arrangement. The additional baffles 42 can be similarly interlocked with the rearmost baffle 42B so as to form a substantially integrated structure mounted along the noise suppressor body 35. For providing another tongue-in-groove attachment feature, or the like, an annular, projecting forward end of the inner wall 37 of the body 35 of the noise suppressor 10 extends into an outer peripheral recess 73 of the stabilizing ring 56 and is encircled by the outer wall 36 of the body of the noise suppressor.

As further illustrated in FIGS. 1-3, the releasable locking mount or mounting mechanism 75 of the mounting system 11 of the noise suppressor can be provided adjacent the proximal end 38 of the body 35 of the noise suppressor 10. In one example embodiment, the mounting mechanism 75 can include a similar structure as disclosed in U.S. Pat. No. 7,661,349, the disclosure of which is incorporated by reference as if set forth fully herein. For example, the locking mount 75 can include a threaded portion 76 (e.g., at least one internal screw thread) formed along the internal wall of the proximal end 38 of the noise suppressor body 35, which threaded portion is adapted to engage and connect to the corresponding threaded connector 24 of the flash hider body 16 as indicated in FIGS. 2A-3. Such a threaded attachment enables the quick and simple attachment of the noise suppressor over the flash hider 12, and further enables the quick release or removal of the noise suppressor from the flash hider by simply rotating or unscrewing the noise suppressor from the flash hider. Alternatively, the one or more threads 76 may form or be part of a mounting mechanism that does not include the locking mount 75, as will be discussed in greater detail below.

Optionally, a locking latch 77 also generally can be provided adjacent the proximal end 38 of the noise suppressor body 35, which is adapted to engage the annular locking surface 22 of the flash hider 12. As best understood with reference to FIG. 2A, wherein a portion of the locking latch 77 is schematically illustrated by dashed lines, the latching latch can include a pivoting arm 78 having one or more serrated teeth 79 at one end thereof, and which arm is biased toward engagement with the annular locking surface 22 of the flash hider 12 so that the teeth of the locking latch arm are maintained in engagement with the teeth 23 of the annular locking surface of the flash hider. The teeth 79 of the latch arm 78 typically will have a slanted construction such that as the noise suppressor 10 is rotated and threadably mounted onto the flash hider 12, the teeth of the latch arm will ride over the teeth 23 of the annular locking surface 22 of the flash hider until the noise suppressor has been fully mounted thereon. Thereafter, the engagement of the teeth 79 of the latch arm 78 with the teeth 23 of the annular locking surface 22 of the flash hider 12 will serve to help maintain the noise suppressor 10 in a locked condition mounted over the flash hider.

In its locked condition, as shown in FIGS. 2B and 3, the noise suppressor 10 will be secured against rotation by the engagement of its locking latch 77 with the annular locking surface 22 of the flash hider 12. At the same time, the engagement of the distal end 18 of the flash hider 12, for example the engagement of the distal ends of the prongs or tines 26 of the flash hider, by the inner wall 63 of the central opening 58 of the stabilizing ring 56 of the noise suppressor will cause the prongs or tines of the flash hider to be slightly compressed by a minimal amount that does not interfere with the passage of a bullet therethrough, but which compression creates at least a tension force that is applied along the length of the prongs that is sufficient to counteract or dampen vibratory movement of the prongs of the flash hider caused by the passage of high-pressure propulsion gases and bullet(s) through the flash hider and noise suppressor upon firing of the host firearm. Such a tensioned, biased or the like, stabilizing mounting of the noise suppressor over the flash hider 12 further can help maintain engagement between the flash hider and noise suppressor during rapid and/or fully automatic firing of the host firearm. As a result of the enhanced stability provided by the mounting system 11 of the noise suppressor 10, the ability of the host firearm to place a number of rounds within a desired tight grouping with a high degree of repeatability and consistency, especially under high rates of fire, can significantly be improved through the use of the noise suppressor of this disclosure, and can help diminish or substantially eliminate ringing created as bullets pass through the flash hider 12.

In the embodiments illustrated in the drawings, the stabilizing ring 56 can be configured so that the inner wall 63 of the stabilizing ring is substantially cylindrical and defines an inner diameter (i.e., the diameter of the central opening 51) that is substantially the same size as, or slightly smaller than, (e.g., may not be larger than) the outer diameter defined the distal end region 18 of the flash hider 12, wherein the outer diameter defined the distal end region of the flash hider can be defined by the series of prongs or tines 26 that may form the distal end region of the flash hider. Accordingly, the inner wall 63 of the stabilizing ring 56 can be characterized as being an interface region that can be for being in opposing face-to-face contact or engagement with the outer surface of the flash hider 12 proximate the distal end region 18 of the flash hider. When the distal end region 18 of the flash hider 12 is in the form of the series of prongs or tines 26, the inner wall 63 of the stabilizing ring 56 can be for being in opposing face-to-face contact or engagement with the outer surfaces of the series of prongs or tines 26 proximate the distal end region 18 of the flash hider 12.

When the noise suppressor 10 is mounted to the flash hider 12 by way of relative movement therebetween, the distal end region 18 of the flash hider 12, which can be in the form of the series of tines 26, can be inserted at least slightly tightly at least partially into the central opening 58 of the stabilizing ring 56. This inserting can comprise the inner wall 63 of the stabilizing ring 56 engaging at least slightly tightly over and being in opposing face-to-face contact with the outer surface of the distal end region 18 of the flash hider 12, which can be in the form of the series of tines 26. The stabilizing ring 56 and the distal end region 18 of the flash hider 12 can be cooperatively configured so that an interference fit, such as selectively releasable interference fit, is provided therebetween in response to the stabilizing ring engaging over and being in opposing face-to-face contact with the outer surface of the distal end region of the flash hider. That is, the inner wall 63 of the stabilizing ring 56 can apply inwardly directed radial contact pressure around and against the outer surface of the distal end region 18 of the flash hider 12 with sufficient force to provide a releasable interference fit therebetween.

At least partially reiterating from above, the mounting system 11 can be characterized as including the stabilizing ring 56, and the stabilizing ring can be configured for forming an interference fit with a forward portion of the flash hider 12 that is positioned forwardly of the proximal end region 17 of the flash hider 12, wherein the forward portion of the flash hider 12 that forms the interference fit with the stabilizing ring can be the distal end region 18 of the flash hider 12. Accordingly, the mounting system 11 can be characterized as including both a medial mount 11A that is in the form of or comprises the stabilizing ring 56, and a proximal mount 11B, wherein the proximal mount can include one or more of the locking mount 75, one or more threads 76 or a radially inwardly extending flange 90 of the body 35 of the noise suppressor 10. An annular bearing surface 92 of the flange 90 can be for engaging against, or for at least being in opposing face-to-face contact with, an annular bearing surface 94 of the flash hider body 16 for alignment purposes. The flange 90 and the stabilizing ring 56 can be spaced apart from one another along the length of the compound chamber 40 so that an upstream portion of the blast chamber 55 is positioned between the flange 90 and the stabilizing ring. In the embodiments illustrated in the drawings, the flange 90 can be described as at least partially defining the rearmost end of the compound chamber 40. In addition, the annular bearing surface 92 extends around and defines a central opening having a diameter that is larger than the diameter of the central opening 51 of the stabilizing ring 56, and the diameter of the central opening of the stabilizing ring is larger than the diameters of the central openings 47 of the baffles 42.

As at least alluded to above, various features of the noise suppressor 10 extend into the inner compound chamber 40 to divide it into subchambers that can be referred to, for example, as the expansion chambers 43 and the blast chamber 55. For example, the blast chamber 55 can be described as being defined between the rearmost baffle 42B and the proximal end region 38, or more specifically the inner flange 90, of the body 35 of the noise suppressor 10. In addition, the stabilizing ring 56 can be described as being positioned in a medial portion of the inner compound chamber 40, or more specifically in a medial portion of the blast chamber 55, for dividing the blast chamber 55 into upstream and downstream portions, wherein the upstream and downstream portions of the blast chamber can be in fluid communication with one another by way of the central opening 58 of the stabilizing ring 56. In the embodiments illustrated in the drawings, the blast chamber 55, including both its upstream and downstream portions, has a larger diameter than both the central opening 58 defined by the stabilizing ring 56 and the central opening defined by the flange 90.

In the embodiments illustrated in the drawings, when the noise suppressor 10 is mounted over the flash hider 12, the flash hider obstructs the central opening 58 of the stabilizing ring 56 without fully closing the central opening 58 of the stabilizing ring 56, so that the upstream and downstream portions of the blast chamber 55 can be in fluid communication with one another by way of the central passage 28 through the body 16 of the flash hider 12 and the slots 27 between the tines 26.

Figure 5:
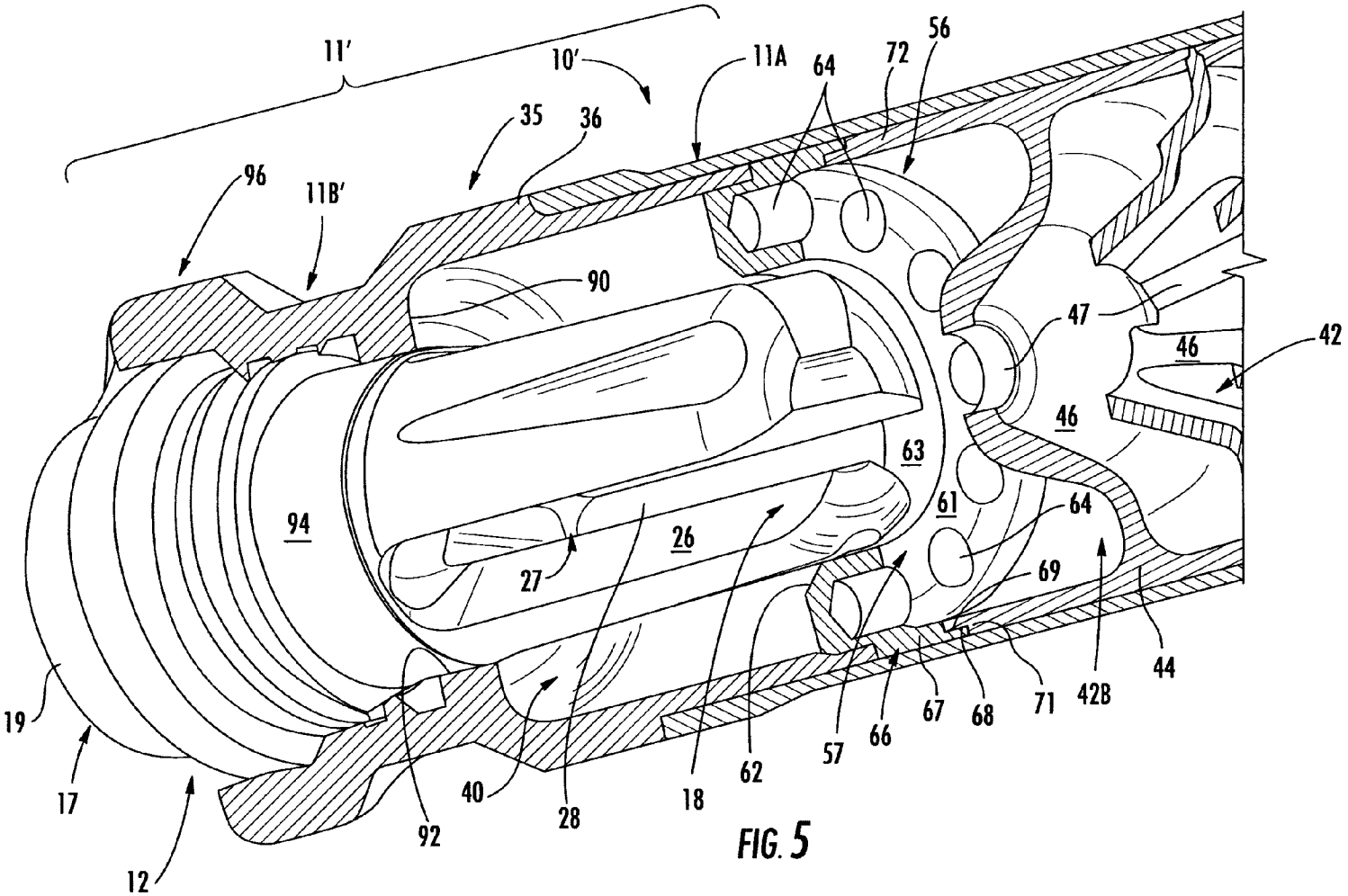
FIG. 5 is a perspective illustration, taken in partial cross-section, of an additional embodiment of the silencer with improved mount, illustrating the engagement between a stabilizing ring of the noise suppressor and the flash hider when the noise suppressor is mounted over the flash hider, without requiring a locking mount.

One or more of the features or mounting portions of the proximal mount 11B can be omitted or configured differently. For example, FIG. 5 illustrates still a further alternative embodiment of the mounting system 11' of the noise suppressor 10. The embodiment of FIG. 5 can be like the embodiment of FIGS. 1-4, except for variations noted and variations that will be apparent to those of ordinary skill in the art.

In the embodiment of FIG. 5, the mounting system 11', or more specifically a proximal mount 11B' of the mounting system 11', can include an internally threaded portion 76 for engaging and attaching the noise suppressor body 35 to the threaded connector 24 of the flash hider body 16 as discussed with reference to FIGS. 1-3. Alternatively, the mounting system 11' (FIG. 5) of the noise suppressor body 35 can be formed without an internally threaded portion, instead including a collar 96 having an inner diameter sized end/or configured to fit over and engage the body 16 of the flash hider 12, including being adapted to contact the body of the flash hider in a contacting, or fitted arrangement, including potentially frictionally engaging the flash hider sufficient to stably mount the noise suppressor over the flash hider, such as by way of an interference fit. The mounting system 11' further will include a medial mount 11A that can be in the form of the stabilizing ring 56 that engages the distal end region 18 of the flash hider body 16 as discussed above (e.g., in a frictional, compressive engagement therewith).

In this embodiment, the noise suppressor 10 can be substantially securely mounted on the flash hider 12 by the use of the frictional or compressive engagement of the distal end region 18 (e.g., the tines 26) of the flash hider body 16 by the stabilizing ring 56 alone, without requiring a further locking mounting mechanism and without otherwise requiring a substantially tight, frictional engagement between the body 35 (e.g., collar 96) of the noise suppressor 10 and a distal portion of the body of the flash hider. During firing of the host firearm, the passage of heated gases and bullets through the flash hider body 16 can cause expansion of the tines 26 of the flash hider 12, thus increasing the frictional/compressive engagement between the stabilizing ring 56 and flash hider to help further stabilize and strengthen this mounting.

In the embodiments illustrated in the drawings, the noise suppressor 10, 10' can be mounted over the flash hider 12 by causing relative movement between the noise suppressor and the flash hider so that the flash hider becomes at least partially positioned within the internal chamber 40 of the noise suppressor and there is both: engaging between the proximal end region 38 of the noise suppressor and the proximal end region 17 of the flash hider, and engaging between a medial portion (e.g., the stabilizing ring 56) of the noise suppressor and a forward region (e.g., the distal end region 18) of the flash hider that is spaced art from the proximal end region of the flash hider. The engaging between the proximal end region 38 of the noise suppressor 10, 10' and the proximal end region 17 of the flash hider 12 can be comprised of engaging between an inner surface of the proximal end region of the noise suppressor and an outer surface of the proximal end region of the flash hider. The engaging between the medial portion (e.g., the stabilizing ring 56) of the noise suppressor 10, 10' and the forward region (e.g., the distal end region 18) of the flash hider 12 can be comprised of engaging between an inner surface of the medial portion of the noise suppressor and an outer surface of the forward region of the flash hider. At least one engaging selected from the group consisting of the engaging between the proximal end region 38 of the noise suppressor 10, 10' and the proximal end region 17 of the flash hider 12, and the engaging between the medial portion (e.g., the stabilizing ring 56) of the noise suppressor 10, 10' and the forward region (e.g., the distal end region 18) of the flash hider 12 can be configured for at least partially mounting the noise suppressor over the flash hider, such as by way of an interference fit.

It further will be understood that the invention is not limited to the particular methodology, devices, apparatus, materials, applications, etc., described herein, as these may vary. It is also to be understood that the terminology used herein is used for the purpose of describing particular embodiments only, and is not intended to limit the scope of the invention. It must be noted that as used herein and in the appended claims, the singular forms "a," "an," and "the" include plural references unless the context clearly dictates otherwise.

Unless defined otherwise, all technical and scientific terms used herein have the same meanings as commonly understood by one of ordinary skill in the art in the field to which this invention is directed, and it will be understood that any methods and materials similar or equivalent to those described herein can be used in the practice or construction of the invention.

The foregoing description generally illustrates and describes various embodiments of the present invention. It will, however, be understood by those skilled in the art that various changes and modifications can be made to the above-discussed construction of the present invention without departing from the spirit and scope of the invention as disclosed herein, and that it is intended that all matter contained in the above description or shown in the accompanying drawings shall be interpreted as being illustrative, and not to be taken in a limiting sense. Furthermore, the scope of the present disclosure shall be construed to cover various modifications, combinations, additions, alterations, etc., above and to the above-described embodiments, which shall be considered to be within the scope of the present invention. Accordingly, various features and characteristics of the present invention as discussed herein may be selectively interchanged and applied to other illustrated and non-illustrated embodiments of the invention, and numerous variations, modifications, and additions further can be made thereto without departing from the spirit and scope of the present invention as set forth in the appended claims.

What is claimed is:

1. A noise suppressor configured for mounting over a flash hider attached to a barrel of a host firearm, the noise suppressor comprising:

a body having a proximal end and a distal end, the body defining an internal chamber positioned between the proximal and distal ends;

a series of baffles mounted along the internal chamber of the body; and a mounting system comprising:

a proximal mount positioned proximate the proximal end of the body for at least partially mounting the noise suppressor to the flash hider, and a stabilizing ring mounted along the body of the noise suppressor and having a central opening positioned in the internal chamber and configured to receive at least part of a distal end region of the flash hider therein, so as to engage and apply a compressive force to at least one outermost surface of the distal end region of the flash hider sufficient to substantially dampen any vibration of at least one of the noise suppressor and the flash hider created during firing of the host firearm.

2. The noise suppressor of claim 1, wherein the stabilizing ring comprises a series of recesses formed in a forward facing surface thereof.

3. The noise suppressor of claim 1, wherein the stabilizing ring comprises a guide surface formed about the central opening of the stabilizing ring.

4. The noise suppressor of claim 3, wherein the stabilizing ring comprises a series of recesses formed in a forward facing surface thereof.

5. The noise suppressor of claim 1, wherein the central opening is configured to receive a series of prongs of the flash hider in compressive engagement therewith so as to apply at least tension to the prongs.

6. The noise suppressor of claim 1, wherein the proximal mount comprises at least one feature selected from the group consisting of:

an internal thread; and a locking mechanism configured to releasably engage a corresponding locking surface of the flash hider.

7. The noise suppressor of claim 1, wherein the stabilizing ring is positioned in a medial portion of the internal chamber.

8. The noise suppressor of claim 1, wherein:

the internal chamber comprises an initial chamber positioned between the proximal end of the body and a rearmost baffle of the series of baffles, and the stabilizing ring is positioned in a medial portion of the initial chamber.

9. The noise suppressor of claim 1, wherein the central opening of the stabilizing ring has a larger diameter than central openings of at least some baffles of the series of baffles.

10. The noise suppressor of claim 1 in combination with the flash hider, wherein the flash hider extends at least partially into the central opening of the stabilizing ring.

11. The combination of claim 10, wherein there is an interference fit between the flash hider and the stabilizing ring.

12. A noise suppressor configured for mounting over a flash hider attached to a barrel of a host firearm, the noise suppressor comprising:

a body having a proximal end and a distal end, the body defining an internal chamber positioned between the proximal and distal ends;

a series of baffles mounted along the internal chamber of the body, the series of baffles being positioned in the internal chamber, and a portion of the internal chamber being positioned between the proximal end of the body and a rearmost baffle of the series of baffles;

a mount positioned proximate the proximal end of the body for at least partially mounting the noise suppressor to the flash hider; and a stabilizer extending into the internal chamber at a position between the mount and the series of baffles so that the stabilizer at least partially divides the internal chamber, the stabilizer being spaced apart from the mount positioned proximate the proximal end of the body, the stabilizer comprising an inner surface extending at least partially around an opening positioned in the internal chamber for receiving a distal end of the flash hider therein, and the inner surface of the stabilizer being configured for extending at least partially around and engaging at least one outer surface of the distal end of the flash hider, wherein, in combination with the flash hider, the inner surface of the stabilizer engages and applies inwardly compressive force against the at least one outer surface of the distal end of the flash hider.

13. The noise suppressor of claim 12, wherein the inner surface of the stabilizer is an annular inner surface of the stabilizer, the annular inner surface extends around the opening positioned in the internal chamber for receiving the distal end of the flash hider therein, and the annular inner surface is configured for extending around and engaging the at least one outer surface of the distal end of the flash hider.

14. The noise suppressor of claim 13, wherein a diameter of the opening that the inner annular surface of the stabilizer extends around is not larger than an outer diameter of the distal end of the flash hider.

15. The noise suppressor of claim 13, wherein:

the mount positioned proximate the proximal end of the body is comprised of a radially inwardly extending flange that is spaced apart from the stabilizer along the internal chamber;

a diameter of the internal chamber is positioned between the stabilizer and the radially inwardly extending flange of the mount positioned proximate the proximal end of the body; and the diameter of the internal chamber is larger than both:

a diameter of the opening that the inner annular surface of the stabilizer extends around, and a diameter of an opening that an inner surface of the flange extends at least partially around.

16. The noise suppressor of claim 12, wherein the stabilizer comprises a stabilizing ring.

17. The noise suppressor of claim 16, wherein the stabilizing ring comprises a series of recesses formed in a forward facing surface thereof.

18. The noise suppressor of claim 16, wherein the stabilizing ring comprises a guide surface formed about the opening of the stabilizing ring.

19. The noise suppressor of claim 16, wherein the opening is configured to receive a series of prongs of the flash hider in compressive engagement therewith.

20. A noise suppressor configured for mounting over a flash hider attached to a barrel of a host firearm, the noise suppressor comprising:

a body having a proximal end and a distal end, the body defining an internal chamber positioned between the proximal and distal ends;

a series of baffles mounted along the internal chamber of the body, the series of baffles being positioned in the internal chamber, a portion of the internal chamber being positioned between the proximal end of the body and a rearmost baffle of the series of baffles;

a mounting system for mounting the noise suppressor to the flash hider, the mounting system comprising:

a proximal mount positioned proximate the proximal end of the body for at least partially mounting a proximal end region of the noise suppressor to the flash hider, and a medial mount extending into the internal chamber at a position between the proximal mount and the series of baffles so that the medial mount at least partially divides the internal chamber, the medial mount comprising an inner surface extending at least partially around an opening positioned in the internal chamber for receiving a distal end of the flash hider therein, the inner surface of the medial mount being configured for extending at least partially around and engaging at least one outer surface of the distal end of the flash hider.

21. The noise suppressor of claim 20, wherein the medial mount comprises a stabilizing ring.

22. The noise suppressor of claim 21, wherein the stabilizing ring comprises a series of recesses formed in a forward facing surface thereof.

23. The noise suppressor of claim 21, wherein the stabilizing ring comprises an inclined guide surface formed about the opening of the stabilizing ring.

24. The noise suppressor of claim 21, wherein the opening is configured to receive a series of prongs of the flash hider in compressive engagement therewith.

* * * * *